United States Patent [19]

Middaugh et al.

[11] Patent Number: 4,834,608

[45] Date of Patent: May 30, 1989

[54] RAILROAD CAR FOR HAULING LARGE HIGHWAY TRUCKS AND METHOD OF LOADING

[76] Inventors: Frank R. Middaugh, 5983 Post Oak Cir., San Jose, Calif. 95120; Robert J. Austill, 2236 Dianne Dr., Santa Clara, Calif. 95050

[21] Appl. No.: 143,844

[22] Filed: Jan. 14, 1988

[51] Int. Cl.[4] ..... B65G 67/02

[52] U.S. Cl. ..... 414/525.1; 105/372; 410/8; 410/18; 410/29; 410/56; 414/255; 414/786

[58] Field of Search ..... 414/786, 495, 679, 339, 414/542, 543, 234, 255, 259, 352, 341-343, 497, 525.1; 410/3, 4, 7-11, 13, 17, 18, 19, 23-26, 29, 56, 58, 66; 105/370-372, 375

[56] References Cited

U.S. PATENT DOCUMENTS

| | | | |
|---|---|---|---|
| 1,299,912 | 4/1919 | Butterworth | 414/679 X |
| 1,824,369 | 9/1931 | Reid et al. | 410/24 |
| 1,824,370 | 9/1931 | Reid | 410/13 |
| 1,824,983 | 9/1931 | Copony | 410/17 X |
| 1,969,434 | 8/1934 | Snyder | 410/8 |
| 2,009,149 | 7/1935 | Pierce | 105/371 X |
| 2,629,507 | 2/1953 | Olson | 414/255 X |
| 2,802,583 | 8/1957 | Dansereau | 414/343 X |
| 3,242,880 | 3/1966 | Boone | 410/8 X |
| 3,315,825 | 4/1967 | Scheinert | 414/542 |
| 3,875,871 | 4/1975 | Thornton et al. | 105/375 |
| 4,311,322 | 1/1982 | Verros | 105/372 X |
| 4,693,650 | 9/1987 | Smith | 410/18 |

FOREIGN PATENT DOCUMENTS

| | | | |
|---|---|---|---|
| 711498 | 9/1931 | France | 410/13 |
| 1252025 | 11/1971 | United Kingdom | 410/13 |

OTHER PUBLICATIONS

Seattle Post-Intelligencer, Mar. 28, 1947, p. 21, "Just Park It Up There", copy in 414/255.

Newsweek, Mar. 31, 1952, p. 42, copy in 414/255.

Mechanix Illustrated, Oct., 1952, p. 89, copy in 414/255.

*Primary Examiner*—David A. Bucci

*Attorney, Agent, or Firm*—Freilich, Hornbaker, Rosen & Fernandez

[57] ABSTRACT

A railroad car having an extraordinary height is more efficiently utilized for hauling large highway trucks, each having a cab but no body on the frame behind the cab. Raised platforms are provided for the trucks along both sides of a railroad car, leaving a channel for a lifting device to be moved under its own power. The lifting device first lifts one end of a truck at one end of the car and moves the lifted truck back toward the other end of the car. The process is repeated until the railroad car is full.

10 Claims, 6 Drawing Sheets

RAILROAD CAR FOR HAULING LARGE HIGHWAY TRUCKS AND METHOD OF LOADING

BACKGROUND OF THE INVENTION

This invention relates to a railroad car for hauling motor vehicles, and more particularly to a method and apparatus for loading highway trucks having frames without bodies behind the cabs of the trucks for transportation by railroad.

Heavy trucks used for various purposes are customarily assembled with a cab and a frame extending behind the cab, and then transported, or driven, to another location for a body or "fifth wheel" drive to be fitted onto the frame. The fitting locations may be hundreds or even thousands of miles from the truck assembly plant. It is therefore desirable to transport them by rail in a safe and efficient manner.

Presently many highway trucks are carried away from the assembly plant aboard specially equipped railroad flatcars called "saddleback" cars. These cars are equipped with special pedestals and tiedown means for transporting highway trucks of the type described above. "Saddleback" refers to a method of loading the highway truck onto the flatcar so that each truck's front wheels (except the first truck) are positioned above the rear portion of the highway truck just ahead of it. The result is that the front of each truck is substantially higher than its rear, and because its front end is above the rear portion of the next truck ahead, the trucks "overlap" in effect and more can be loaded aboard a flatcar than if they were all loaded end-to-end with all of their wheels resting on the flatcar's deck. The "first" truck, i.e., the truck whose cab is positioned near the end of the flatcar usually has its front wheels placed atop the pedestals referred to above. The trucks behind it have their front wheels or front axles secured in an elevated position by means of either wheel pedestals resting on the flatcar's deck or by a temporary device attached to the top of the frame of the truck next ahead.

To load, the truck's front end is raised by a special crane that straddles the flatcar and moves along the deck of the flatcar until its front end is positioned in the desired location above the rear of the truck next ahead. The front end of the truck is then lowered and secured, and the straddle crane travels back to the next truck to be loaded, repeating the process until the flatcar is fully loaded. The trucks may be tied down to the deck of the flatcar by chains or by other means.

The "saddleback" system presently used for transporting highway trucks aboard railroad flatcars has several shortcomings. First, during the loading process the straddle crane must pick up the front of the truck. Usually this is done by attaching a chain or cable to the truck's front bumper. In recent years all motor vehicle manufacturers have made a concerted effort to lighten their vehicles in order to either improve fuel economy or increase carrying capacity. Truck bumpers have been lightened in the course of this campaign by reducing the thickness of the metal from which they are made. Obviously this makes the bumpers weaker, and bumper damage during loading and/or unloading of trucks has become a major problem with many complaints by manufacturers and dealers to the rail carriers. Some attempt has been made to lift the truck's front wheel axle instead, but this practice has not become widely adopted, so the bumper damage problem remains.

Another shortcoming of the saddleback system for loading is that the trucks are completely exposed on top of the deck of the flatcar. Thieves and vandals can gain ready access to the trucks by simply climbing onto the freight car. These persons often break a window in the truck cab in order to reach inside, unlock a door and climb inside the cab. Once inside, these persons often steal the radio and/or other equipment, slash the upholstery, or otherwise seriously damage the interior.

Complete exposure also often results in exterior damage to the truck's body and glass from casual vandals who throw missiles such as rocks, slash the tires and/or fire guns at the trucks aboard the open-top flatcar. As with the bumper damage, this greatly displeases the manufacturers and dealers and repairs must be paid for by the rail carriers.

The enclosed rail car that is the subject of this invention solves these problems. First of all, it is difficult for a casual vandal to even ascertain whether the subject car is loaded or not, because it is completely enclosed. From a distance, even a person intending to fire a gun would not know where to aim, since he cannot see the highway trucks, and his odds of hitting a truck are greatly reduced even though his bullets will undoubtedly penetrate the side screens of the car. Missiles thrown at the car by vandals will bounce off the enclosing screens, leaving the truck's glass and body undamaged.

A traveling jack on the bed of the enclosed railroad car picks up the front of each truck in sequence by its front axle instead of its front bumper. This axle is one of the strongest parts of the truck designed and intended as a component that can be used for lifting purposes, and its use eliminates the damage caused by using the bumper as a lifting point. Longitudinally moveable wheel seat rests or platforms eliminate the need for temporary devices attached to the frame of another truck to hold the front of the truck at an elevated position. If desired, the wheel platforms can be shaped to cradle the front wheels of the truck to prevent fore and aft movement and to obviate the need for tiedown chains. The wheel platforms also permit the front wheels of the truck to be elevated to a maximum height, optimizing the number of trucks that can be loaded abroad a railroad car of a given length.

Sloped "curbs" located on the outer sides of the car deck serve to guide the rear wheels of the truck during loading and unloading, maintaining correct positioning of the truck on the car deck throughout each of these processes.

Recently railroad cars have been developed that are longer and higher to satisfy a need for more efficient damage-free transportation of motor vehicles. One such railroad car of 89-foot 4-inch nominal length has two decks for transporting automobiles, with clearance above each deck having a height of about six feet. The sides, top and ends are enclosed to prevent pilferage, vandalism and road hazards while the automobiles are in transit by rail. Such a railroad car could haul as many as seven (7) automobiles on each deck.

An object of this invention is to adapt such an 89-foot railroad car, or other railroad car of extraordinary height (defined as having an inside dimension of about 12 feet, or more, in height from the surface of the bottom deck to the roof) to the task of hauling large trucks efficiently. Because of the height of the truck cabs, it is not possible to carry them on two decks, and because of their length, it is not possible to carry more than two or three, depending on their length. For example, using an 89-foot railroad car to haul trucks that have a 24-foot frame behind an 8-foot cab, three trucks having a total length of 96 feet cannot be accommodated, and just two trucks having a total length of 67 feet would leave an empty space of 22 feet. It would not be practical to always search for another shorter truck to haul with the two larger ones in order to utilize all of the space in the railroad car, and if the railroad car is of extraordinary height, such as one built for this purpose or converted from a double-deck car to a single deck, there would also be a lot of overhead space inside the car not utilized.

SUMMARY OF THE INVENTION

In accordance with the present invention, the space of a railroad car having an extraordinary height is more efficiently utilized for hauling large highway trucks, each having a cab but no body on the frame behind the cab. Raised wheelways or platforms are provided for the trucks on both sides of the railroad car deck along its length, leaving a channel at the longitudinal center of the deck for a lifting device to be moved manually or under its own power along the length of the channel so that once the front end of a truck positioned at one end of the railroad car has been lifted by the lifting device, the truck can be moved backward toward the other end of the railroad car. Sloped curbs located on the outer sides of the car platform guide the rear wheels of a truck while it is being backed into position. The first truck is loaded at the opposite end of the railroad car and secured in place with its front wheels supported in an elevated position by foldable longitudinally moveable wheel platforms positioned along the side of the railroad car. The hinged platforms are positioned at suitable intervals along side rails that run the length of the car, about half way up each side, so that when the platform is pivoted to a horizontal position and secured by diagonal supports, the lifting device may be operated to lower the front wheels of the truck onto the hinged platforms, and then to move by manual force or under its own power in preparation to lift the front end of the next truck that is to be loaded. Conventional chains, wheel chocks, or other means may be applied to tie down the front and rear wheels so that the truck cannot roll backward or forward. In that manner, a car load of trucks is backed into the railroad car, one truck at a time, with the front wheels elevated and the rear end of the truck frame fitting under the front wheels and cab of the preceding truck. The lifting device is preferably a hydraulic lifting jack actuated by an electric motor driving a hydraulic pressure pump. The longitudinal travel drive for the lifting device may be manually driven but preferably is also hydraulic powered from the same hydraulic pump. Sets of V-grooved wheels for the lifting device run on tracks having an inverted V cross section to guide the lifting device. Power is delivered to at least one set of the wheels for the lifting device by a hydraulic motor through a sprocket and chain arrangement or a large gear that meshes with a gear keyed to the axle of the driven wheels.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
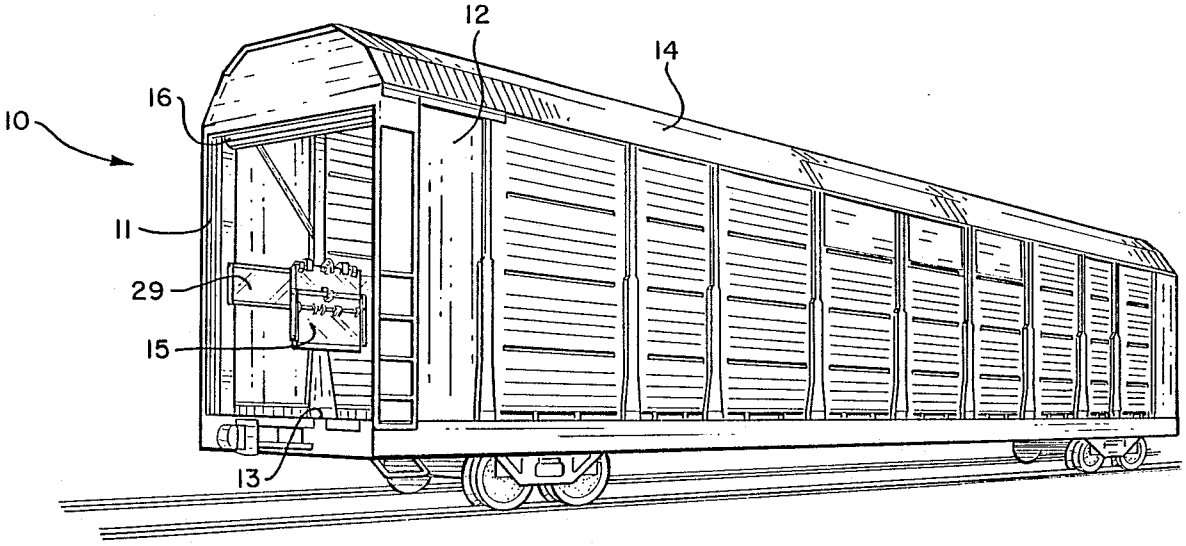
FIG. 1 is a perspective view of a railroad car having extraordinary height for hauling large trucks.
Figure 2:
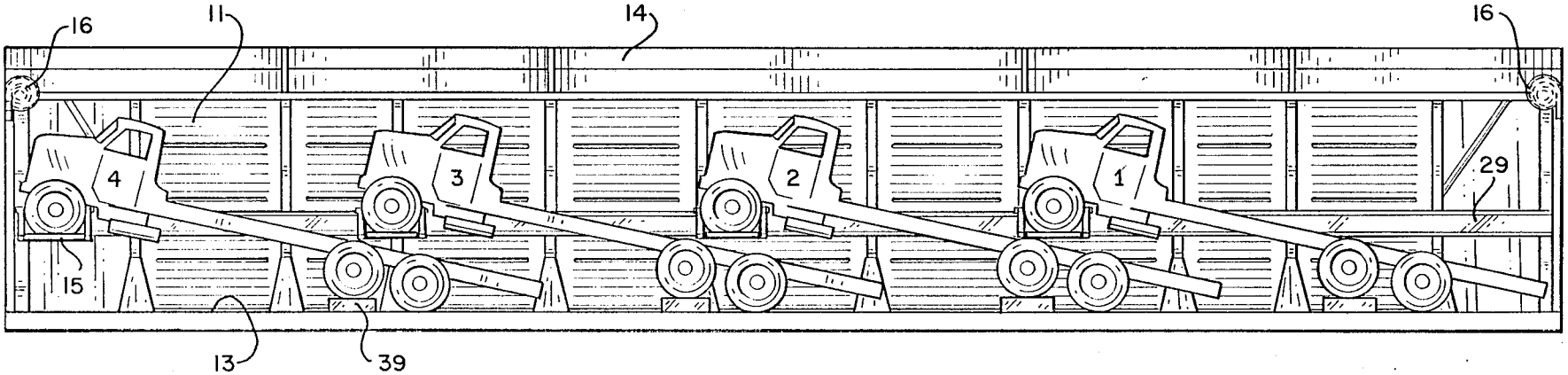
FIG. 2 illustrates the method of loading large trucks in accordance with the present invention to maximize the load for a fixed length of railroad car.
Figures 3, 4:
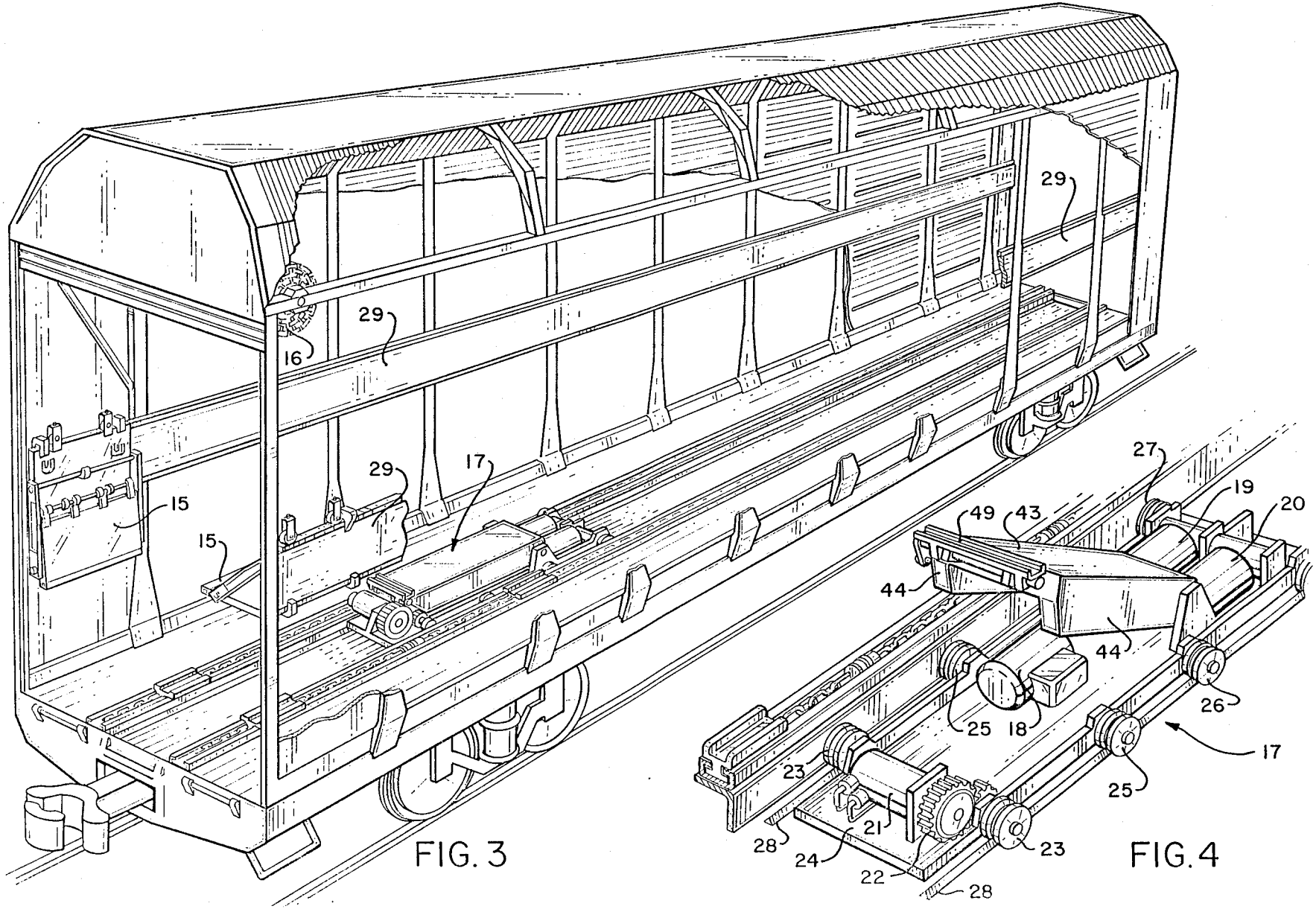
FIG. 3 is a larger view of the railroad car of FIG. 1 with walls partially broken away to show a channel and track for a powered lifting device that may travel the length of the car, and to show hinged platforms that may be positioned anywhere along the length of side rails to hold in an elevated position the front wheels of a truck after it is loaded onto the railroad car and positioned as shown in FIG. 2.
FIG. 4 illustrates in greater detail the powered lifting device having four or more V-grooved wheels on tracks having an inverted V cross section, and a large gear driven by a hydraulic motor for turning a gear keyed to the axis of one set of wheels. Also shown on one side of the lifting device is a conventional channel for positioning tie-down blocks alongside a loaded truck to secure the truck by chains, as shown in FIG. 10.

Referring to FIG. 1, a railroad car 10 having side walls 11 and 12 of extraordinary height (about 12 feet) from the deck 13 to an arcuate roof 14 is adapted for carrying large highway trucks that have frames without bodies behind the cabs, as shown in FIG. 2. With the front end of each truck lifted from its front axle onto wheel-seat platforms 15 that are hinged so that they may be stowed flat against the side of the car when not in use, as shown in FIGS. 1 and 3, and described more fully hereinafter with reference to FIGS. 6, 7 and 8. The railroad car is equipped with a roll-up door 16 at each end so that the trucks may be loaded and unloaded from either end by backing the trucks in from the loading dock.

The loading procedure for the trucks illustrated in FIG. 2 is assumed to have been from the left end, and that the trucks 1, 2, 3 and 4 have been loaded in that sequence. Truck 1 is first backed into the freight car in approximately the position of truck 4, and then the front end is raised by a lifting device 17 shown in FIGS. 3 and 4, and described more fully hereinafter with reference to FIG. 5.

Referring to FIGS. 3 and 4, lifting device is equipped with a hydraulic pump driven by an electric motor in a housing 18 and two hydraulic cylinders 19 and 20. The hydraulic pump also provides hydraulic fluid under pressure for driving a hydraulic motor 21 which, through a gear 22 turns the axle of a first set of wheels 23, as more clearly shown in FIG. 5.

The entire lifting device is mounted on a plate 24 carried by the set of wheels 23, and three other sets 25, 26 and 27. Each of the wheels is V-grooved, and rolls on a rail 28 having an inverted V cross section. That arrangement not only maximizes the alignment of wheels along the rails 28 to guide the raised front end of a truck as it is being backed into position by powered wheels of the lifting device, but also optimizes the traction of the powered set of wheels. Curbs shown in FIG. 3 along the outer sides of the railroad car 10 guide the rear wheels of a truck being backed into position. To increase the drive power, the set of wheels 23 may be coupled to the next set of wheels 25 by sprockets and chain, or gear trains (not shown).

Figure 7:
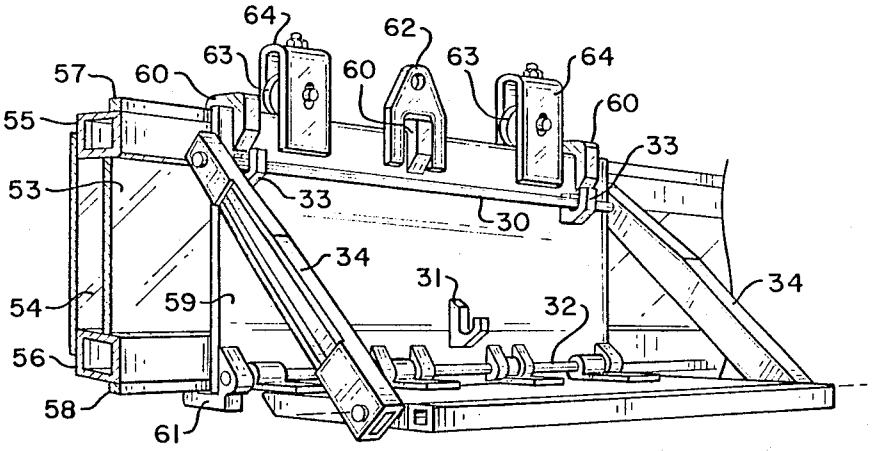
FIGS. 6, 7 and 8 illustrate the details of a hinged platform for the elevated front wheels of a loaded truck.
Figure 6:
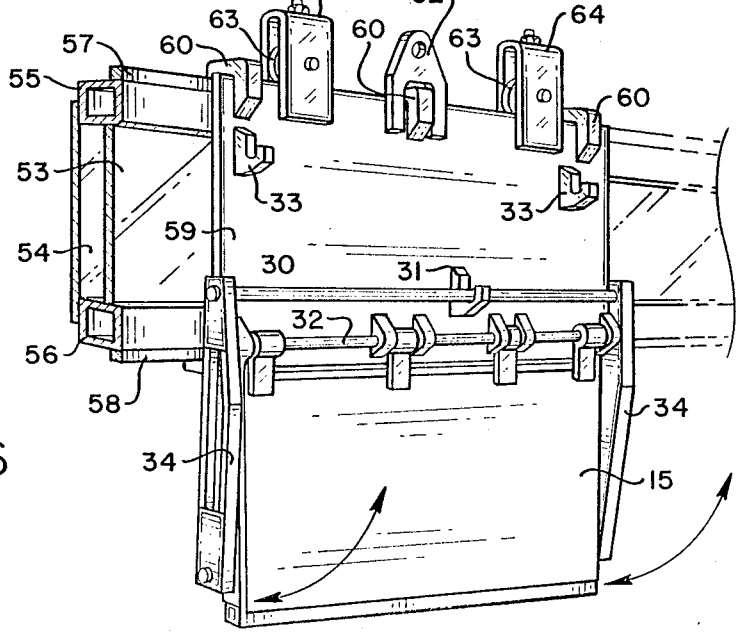

With the front end of truck 1 raised by the device 17 from the front axle, the device 17 is directed to move slowly from the left end of the car 10 toward the right end until the end of the truck frame is within inches of where the roll-up door 16 will close. Then wheel-seat platforms 16 are positioned along side rails 29 on each side. Initially the platforms hang alongside the railroad car as shown in FIG. 6. Referring to just one side, when the platform is in position opposite the front wheel of the truck, a cross-bar 30 is lifted from a hook 31 and as the platform 15 is pivoted up on a pivot rod 32, the cross-bar 30 is lifted onto two hooks 33, as shown in FIGS. 6 and 7. Arms 34 then hold the wheel-seat platform in a horizontal position.

Figure 10:
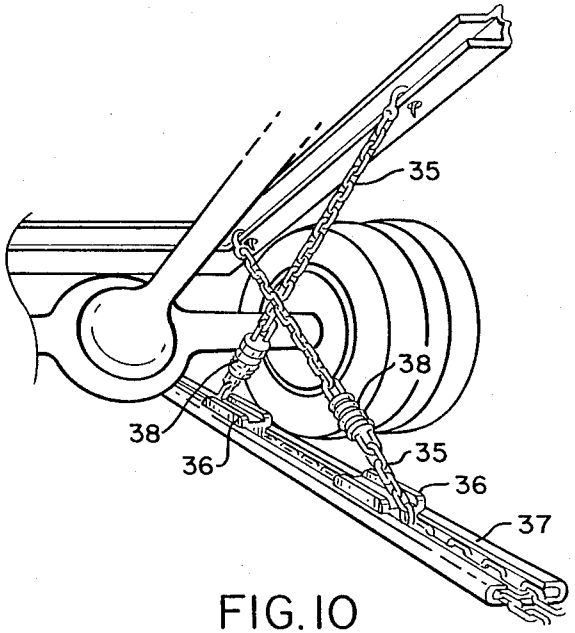
FIG. 10 shows the tie-down positioning device mentioned in reference to FIG. 4.
Figure 9:
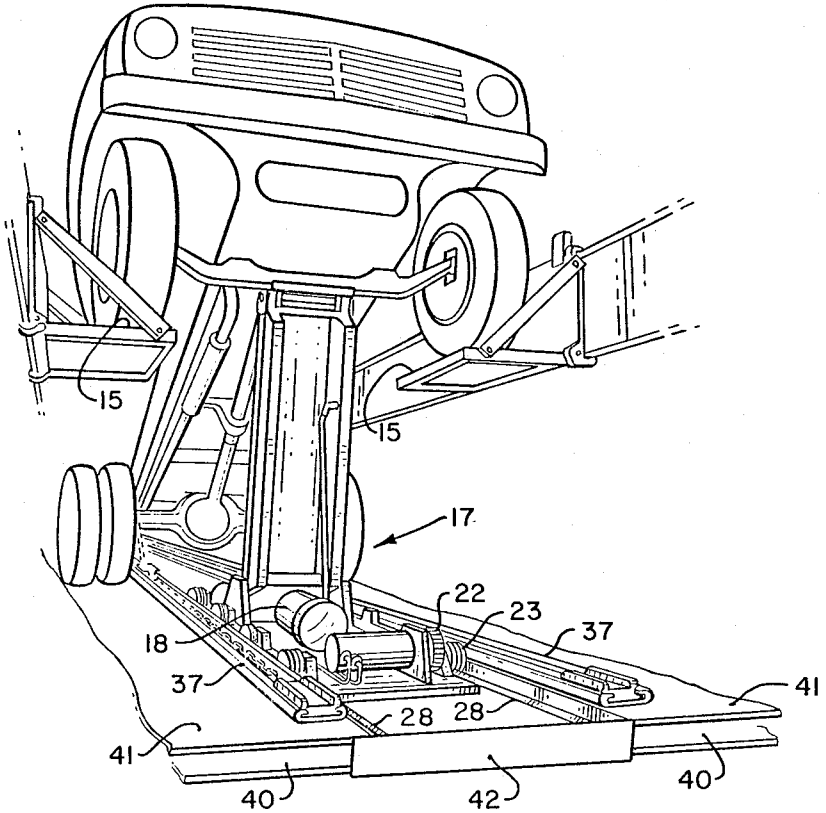
FIG. 9 shows details of the lifting device mentioned in reference to FIG. 5 and hinged wheel platforms mentioned in reference to FIGS. 6, 7, and 8.

Once wheel-seat platforms have been positioned opposite the two front truck wheels and raised to their horizontal position with the cross-bar 30 in the hooks 33, as shown in FIG. 9, the lifting device 17 is lowered so that the front end of the truck is allowed to seat with its two front wheels on the platforms. The truck is then tied down in position by chains 35 secured to conventional tie-down blocks 36, as shown in FIG. 10. Once tension is placed on the chains, the blocks cannot slide in their channel 37.

Although tie-down chains are shown only on one side of the truck, it should be understood that both sides of the truck are tied down. It should also be understood that the chains are shown for convenience with hooks at their ends inserted into holes in the frame of the truck. In practice the chains are looped around the frame and their ends are hooked to links in the chain.

A conventional expansion link 38 is included in each chain. This link is essentially comprised of hard rubber rings between two metal disks. One disk on one side of the rubber rings is connected to the chain on the other side of the rubber rings through a rod and the other disk on the other side of the rubber rings is connected to the chain on the first side of the disk. Tension on the chain thus draws the two metal disks toward each other compressing the rubber rings. When the tension is relieved, the rubber rings expand. While in transit, the truck may thus move up and down a slight amount permitted by the pneumatic tires of the truck, but the expansion links 38 will maintain the chains taut so that they will not permit the blocks to slip in the channels.

Trucks having tandem or dual tandem wheels in the back will have the front set of the tandem wheels elevated off the deck of the railroad car, as shown in FIG. 1. To relieve the stress on the truck frame due to the weight of the elevated wheels, blocks 39 of wood are placed under the elevated wheels, as shown in FIG. 1.

Once truck 1 has been positioned and secured, and the lifting device is lowered, it is moved under its own power to the left end of the railroad car, as viewed in FIG. 1 to lift the front end of truck 2 which is backed into the railroad car. After lifting the front end of the truck, the lifting device is used to back the lifted truck to the right with the frame of truck 2 moving under the elevated front end of truck 1. It is then tied down. Truck 3 is similarly lifted, backed in and tied down. The last truck 4 is backed into the railroad car with its frame under the front end of truck 3. This is possible because the front wheel platforms for the trucks are higher than the frames of the trucks. It is therefore not necessary to elevate the front end of the truck 4 in order to back it into position, but the front end is nevertheless elevated onto frontwheel platforms 15 in order to assure ample clearance between the rear end of the frame of truck 4, and the underside of truck 3.

It should be noted that the lifting device must be moved under its own power from the rear of the next truck to be positioned and tied down to a position at the front of the next truck for lifting the front axle. Although the lifting device is made with a very low profile, as shown in FIG. 3, the clearance under the differential gear box of the next box is not the same for all trucks. Consequently, to assure that there is sufficient clearance for all trucks of different makes and sizes, the deck 40 of the railroad car is provided with platforms 41 about $4\frac{1}{2}$ inches above the deck 40 on both sides of the inverted V guide rails 28 for the lifting device 17, as shown in FIG. 9. In that way, $4\frac{1}{2}$ inches of additional clearance is provided for the lifting device 17 to pass under the differential gear box of the trucks. A plate 42 closes the end of the $4\frac{1}{2}$-inch channel so that the lifting device is not inadvertently caused to move off the end of the deck 40. The channels 37 for the tie-down blocks are secured on top of the platforms 41.

Curbs to guide the trucks while being backed into position may be provided on the outside of the truck wheel platforms 41 in the form of elongated plates less than a foot wide welded to the sides of the railroad car at an angle of about 115° from the platform. The platform is preferably made of metal plate, so welding the curb plates in place is feasible. If the rear wheels start to roll up the metal curb plate on one side, the rear end of the truck will tend to slide over until the wheels on both sides once again roll on the platforms 41. However, it has been found that the lifting device can back a truck into position without once touching the curbs because the lifting device is so well guided. Since a metal plate is slippery when wet, the wheel platforms are preferably provided with a rough surface, such as sand on a thin layer of epoxy over the metal.

In summary, by providing raised platforms for the trucks on both sides of a channel for the lifting device to be moved for positioning a truck while lifted from the front axle, the first truck loaded is positioned at the other end with the front wheels supported by hinged wheel platforms. Each succeeding truck loaded is lifted by the front axle and backed in under the cab of the preceding truck. Each time a truck is secured in place, the lifting device is moved forward under its own power to pick up the front axle of the next truck.

It is recognized that modifications and variations in the equipment used to implement this invention may readily occur to those skilled in this art, such as in the lifting device, hinged front wheel platforms, and tie-down equipment. Since the latter is so conventional, nothing further needs to be described, but the lifting device and the hinged frontwheel platforms will now be described in more detail as the preferred embodiment at the time of filing this application.

Figures 5, 5A, 5B:
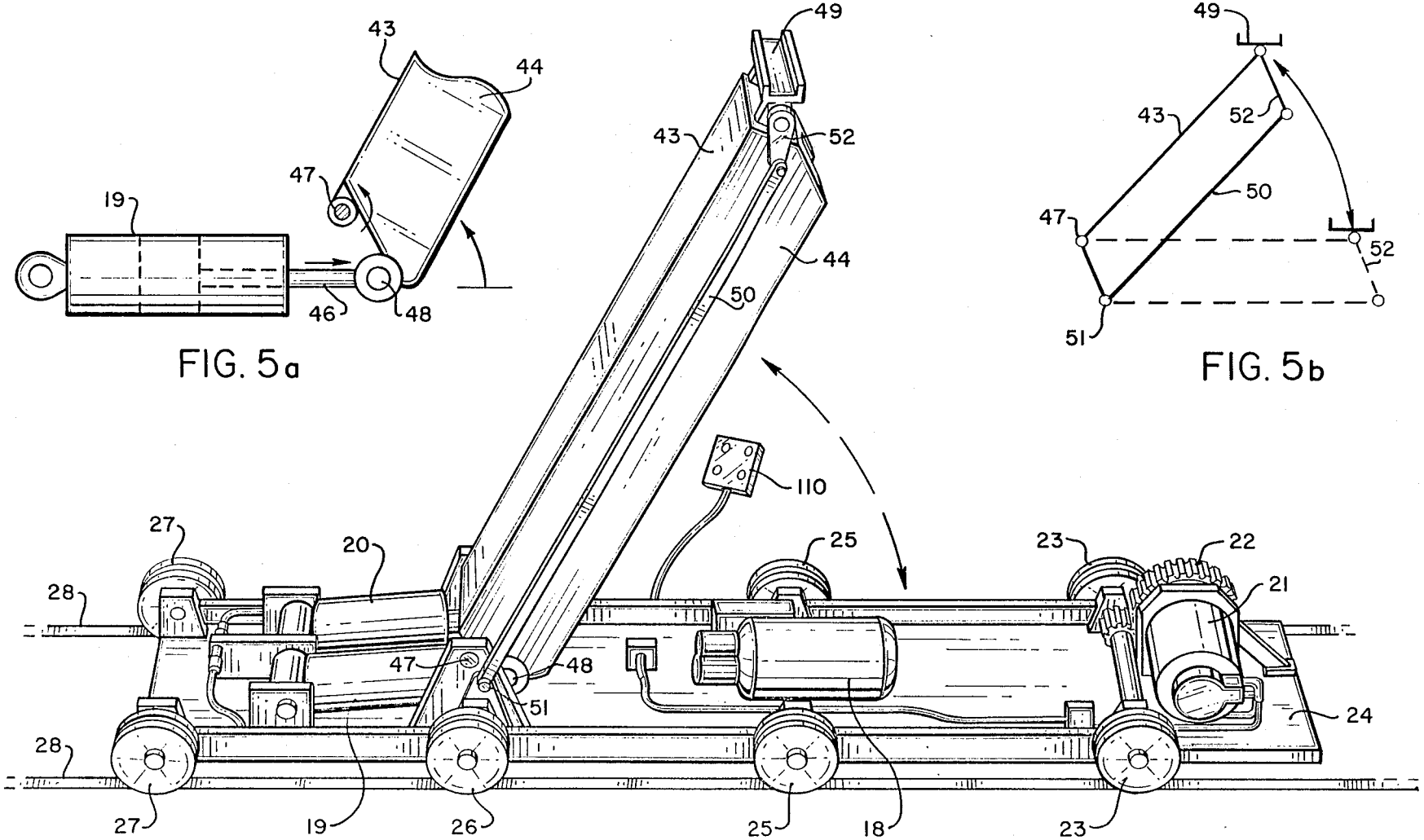
FIGS. 5, 5*a* and 5*b* illustrate the details of the lifting device as it operates to lift a truck by the front axle, as shown in FIG. 9.

Referring to FIGS. 4 and 5, the lifting device is comprised of a hollow lever 43 with reinforcing sides 44. Both the lever 43 and its reinforcing sides are made hollow with interconnecting fluid passages to serve as a reservoir of hydraulic fluid. The electrically driven hydraulic pump 18 provides fluid under pressure to parallel cylinders 19–20 having pistons connected by arms 46 to the lower end of the lever 43 as shown in FIG. 5*a*. The lever 43 pivots about a rod 47 as the piston of the cylinder pushes out against a heavier rod 48. The distance between the two rods 47 and 48 is all the mechanical advantage the lifting device has; to have provided more would have resulted in a high profile. However, two cylinders with piston working in parallel from the same hydraulic pressure source has been found quite adequate. Pivoted at the outer end of the lever 43 is a U-shaped bar 49 which will fit under the front axle of the truck, as shown in FIG. 9.

In order that the bar will retain its upright position to cradle the axle as the front end of the truck is lifted, there is provided a link 50 pivoted at a point 51 and connected to a crank arm 52. When the lever 43 is in a horizontal position, the link 50 will also be parallel, and the axis of the crank arm 52 will be parallel to a line passing through the respective pivot points 47 and 51 of the lever 43 and the link 50. In that way, the upright position of the U-shaped bar will be maintained for nay angle of the lever 43. This is so because as the lever 43 is pivoted up by the hydraulic pistons, the link 50 will maintain a position parallel to the lever 43. Consequently, the other two opposing sides of the parallelogram will always retain their parallel relationship, and the U-shaped arm will retain its upright position throughout, as illustrated schematically in FIG. 5*b*.

The manner in which hydraulic fluid is controlled to lift and lower the lever 43, and to drive the lifting device forward and backward is through a control box 110 on an electric cable or pendant and having pushbuttons to control the movement of hydraulic fluid through solenoid actuated valves for up, neutral and down movement of the lever 43, and forward, neutral and backward for the wheels 23. The operator simply walks alongside the lifting device with the control box 110 in hand while backing a truck into position. He then returns the lifting device to a position at the front end of the railroad car, sets the control box on the lifting device and backs the next truck to be loaded over it. He can then take the control box in hand again and proceed to lift and back the next truck into position.

Electrical power to the lifting device is from a heavily insulated cord. A junction box is preferably provided inside the railroad car to which power is connected from the outside using another heavily insulated cord. The power cord inside the railroad car is carried by a trolley (not shown) on an overhead track. Alternatively, power is applied to the track and the trolley collects electric current form the overhead track and transmits it to the lifting device where it is used to operate the electric motor which drives the hydraulic pump, and to energize solenoids in response to the push buttons of control box 110 for control of the hydraulic power to lift lever and drive wheels.

Figure 11A:
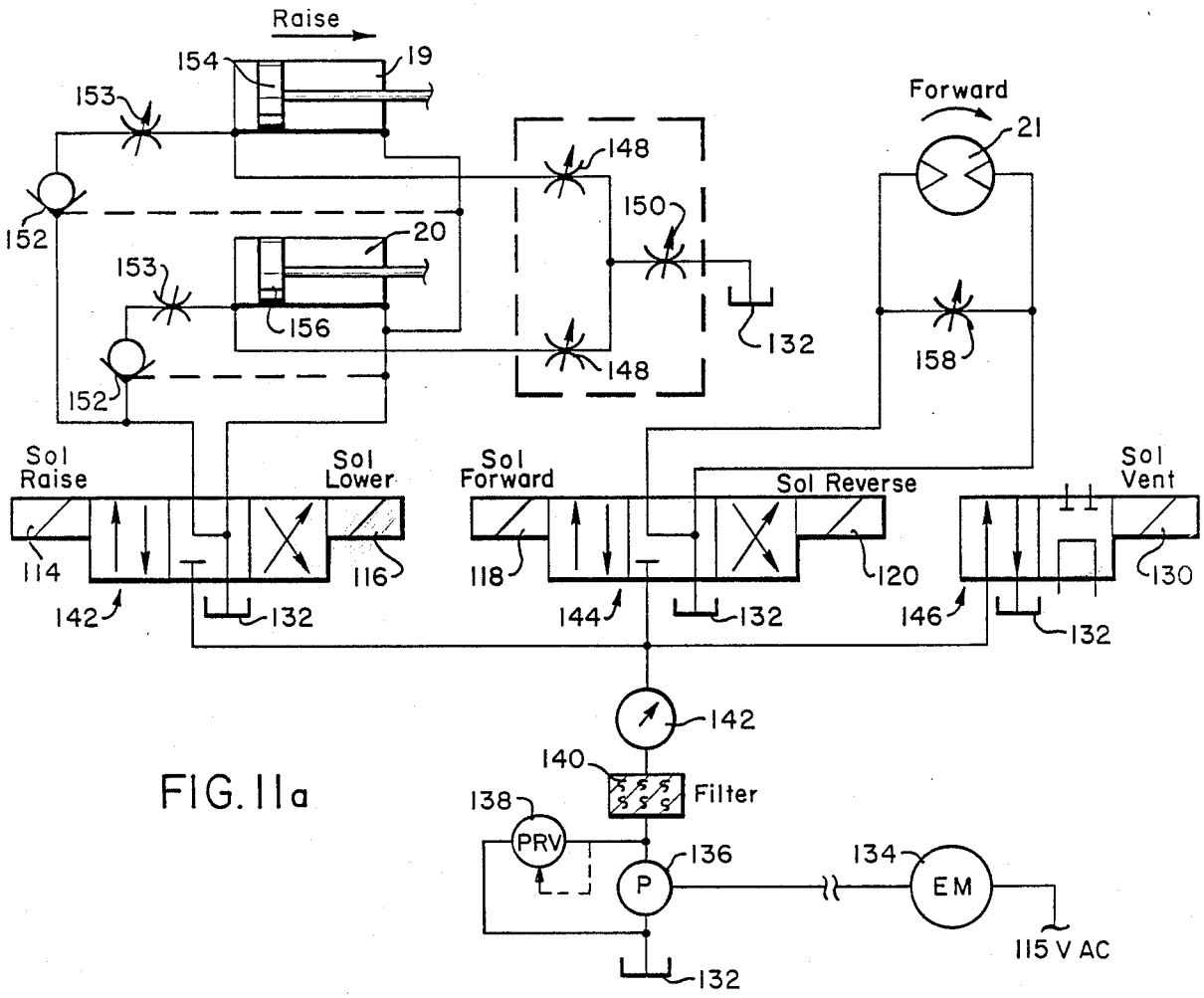
FIGS. 11*a* and 11*b* ilustrate schematically the hydraulic and electrical circuits for controlling operation of the preferred embodiment of the present invention.
Figure 11B:
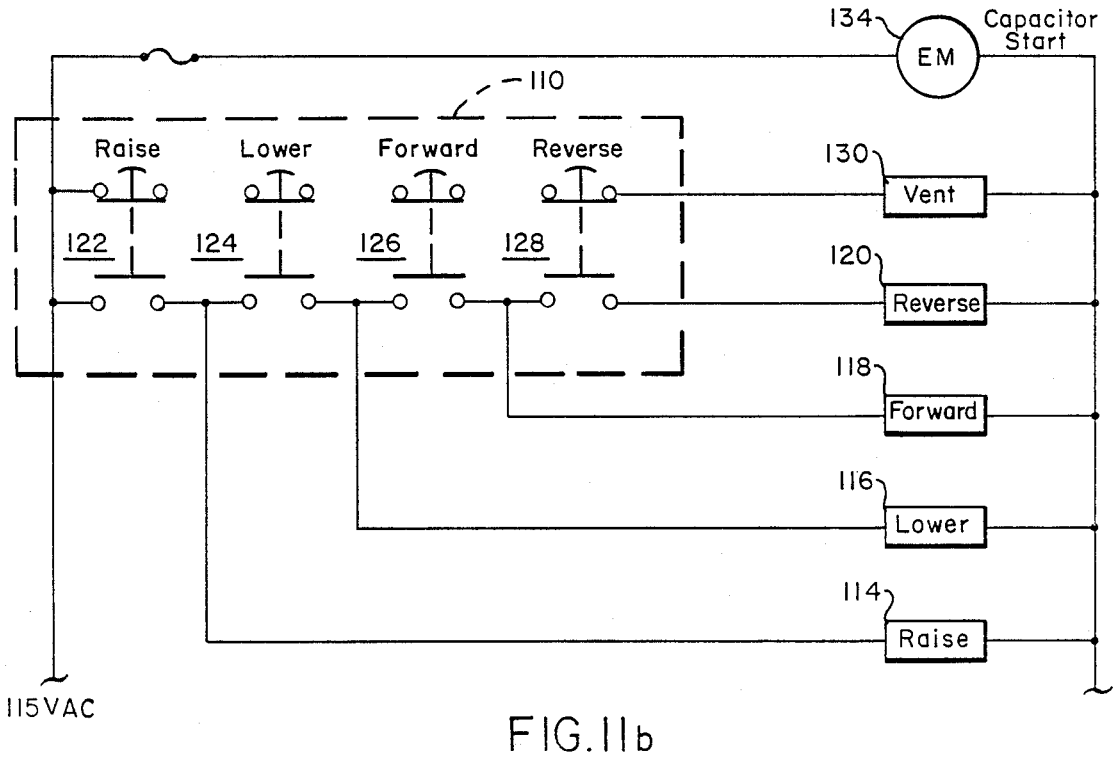

FIGS. 11*a* and 11*b* illustrate diagramatically the fluid and electrical circuits necessary to actuate solenoids that control hydraulic cylinders 19 and 20, and motor 21.

Four solenoids 114, 116, 118, and 120 are employed, with solenoids 114 and 116 respectively operating to place cylinders 19 and 20 in modes for raising and lowering the hydraulic lever 43. Solenoids 118 and 120 respectively operate to drive motor 21 in forward and reverse. Control box 110 (FIG. 11*b*) is provided with four push-button switches 122, 124, 126, and 128, each connected to a respective one of the solenoids 114, 116, 118, and 120. When all of the switches are closed in series with a fifth solenoid 130, as seen in FIG. 11*b*, the hydraulic fluid will be vented to the reservoir 132 which can be located inside arms 43 and sides 44 as indicated with respect to FIGS. 4 and 5. When any of the switches are moved to the alternate position from that seen in FIG. 11*b*, the associated one of the solenoids will be actuated to perform the desired operation.

Referring again to FIG. 11*a*, once power is supplied to the electrical circuit, a motor 134 in housing 18 will start and actuate fluid pump 136 also disposed in housing 18. A conventional pressure relief valve 138 is in parallel with pump 136 to limit pressure to, for example, 2500 psi. A filter 140 cleans the fluid flow, while a gauge 142 provides a visual indication of the pressure from pump 136.A flow of 2 gpm has been found satisfactory.

Each solenoid pair 114, 116 and 118, operates an associated one of valves 142 and 144 to route fluid. A valve 146 is associated with solenoid 130 so that fluid normally is vented, but closes whenever any of the switches is depressed to break the circuit.

Needle valves 148 and 150 provide pressure relief into the reservoir 132 whenever the cylinders 19 and 20 lower the lever 43, while check valves 152 with associated pilot lines permit the cylinders to raise the lever 43 by relieving pressure behind the pistons 154, 156. Needle valves 153 regulate flow into cylinders 19 and 20 during raising operations. Needle valve 158 forms the neutral by-pass line for the motor 21 while the carriage is being moved neither forward nor in reverse.

Figure 8:
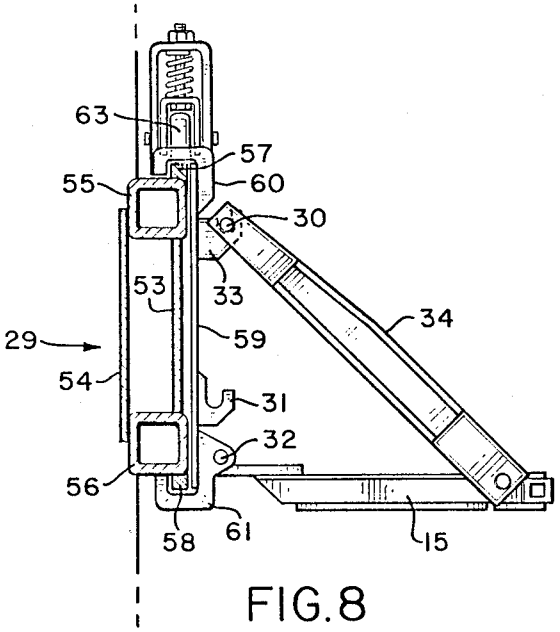

The hinged wheel-seat platforms 15 will now be described in greater detail with reference to FIGs. 6, 7 and 8. The side rails 29 that are affixed to the sides of the railroad cars, as shown in FIG. 2, consist of two plates 53 and 54 welded to square tubes 55 and 56 as best shown in FIG. 8, which are in turn welded to posts that support the side walls of the railroad cars.

Square rods 57 and 58 are welded along the top front and bottom front of the square tubes 55 and 56, respectively. The side rails thus provided carry the hinged wheel platforms 15.

Each hinged wheel platform consists of a back plate 59 to which the hooks 31 is welded. There are also three hooks 60 welded on top of the plate 59 in a position to reach back and over the upper rail rod 57, and two hooks 61 welded on the bottom of the plate 59 in a position to reach back and under the lower rail rod 58 as shown in FIG. 8. These hooks hold the hinged wheel platforms on the rails once the plate of each is fitted onto the rail at one end while hoisting it from a welded tab 62 with a hook through a hole and then positioned along the rail. A pair of spring-loaded wheels 63 held by U-shaped brackets 64 holds the hooks 60 off the upper rail bar 57 so that the hinged wheel platform assemblies may be more easily moved along the side rails 29 to their proper positions opposite the front wheels of the trucks as they are loaded.

As noted hereinbefore, the hinged wheel platform 15 is hinged on the rod 32. When the hinged wheel platform is in place opposite the front wheel of a lifted truck, the platform is pivoted out from its vertical hanging position to a position slightly past horizontal. At the same time, the cross bar 30 is lifted from the hook 31 onto hooks 33. Arms 34 then hold the platform in a horizontal position. The front end of the truck is then lowered until its front wheels are fully supported by the hinged platform in its horizontal positions.

Although preferred embodiments have been illustrated and described, it is recognized that modifications or equivalents may readily occur to those skilled in the art. For example, the wheel platforms 41 on both sides of the railroad car may be raised more at just the loading end of the railroad car, where the lifting device 17 must pass under the differential gear box of the next truck backed in for loading. In that way a minimum of vertical space is sacrificed for the lifting device which requires clearance only at the end of the railroad car where the trucks to be loaded are backed in, one truck at a time. Also, although the lifting device is illustrated as a hydraulic jack on a plate having wheels that are driven by hydraulic power, those wheels may be driven by an electric or pneumatic motor, or may even be manually powered. Consequently, it is intended that the claims be interpreted to cover such modifications and equivalents.

What is claimed is:

1. A method for loading large highway trucks in an enclosed railroad car of extraordinary height for transportation, said trucks having cabs requiring vertical space of about half the internal height of sidewalls of said railroad car, and each truck having a frame without a body behind its cab, comprising the steps of backing each truck to be loaded into said car in sequence at one end of said car, one truck at a time, lifting the front end of each truck, after it is backed into said railroad car in sequence, a height equal to about half the height of said railroad car, positioning the first truck at the far end of said car with its front end in a raised position, and positioning each subsequent truck with its front end lifted and its rear frame under the lifted front end of a preceding truck, and securing each truck thus positioned so that it will neither roll nor slide forward to backward while its front end is held in a raised position, wherein said enclosed railroad car includes a powered jack on powered wheels for lifting the front end of each truck in sequence, and wherein the step of positioning the truck in sequence consists of raising the front end of the truck with said jack under the truck's front axle, and backing the truck into position with the front end raised using the powered wheels of said powered jack to move and guide each truck into position.

2. A method as defined in claim 1 wherein said enclosed railroad car is provided with parallel tracks equally spaced from the centerline of said railroad car, including the step of guiding said powered jack with said parallel tracks while backing a truck into position.

3. A method as defined in claim 1 including the step of securing the front wheels of each truck in their raised position by positioning and raising hinged wheel platforms under each front wheel, said wheel platforms being hinged on a plate, and said plate being adjusted in position along a length of a side rail secured to a side wall of said railroad car.

4. A method as defined in claim 3 wherein said enclosed railroad car includes a deck with sides and is provided with raised wheel platforms along the sides of the deck of said railroad car, thereby leaving a channel for said parallel tracks and said powered jack, including the step of backing a truck to be loaded over said powered jack before raising the front end of said truck to be loaded form the front axle, and then backing said truck to be loaded into position when said front end raised and said powered jack guided by said parallel tracks.

5. Apparatus for loading large highway trucks having a front end, front wheels, and rear wheels in a railroad car having an internal height of side walls at least about twice the height of cabs mounted on the front ends of said trucks, each truck having a frame without any body behind its cab, comprising means for raising only the front end of each truck once it is backed into said car at one end, and for backing each truck in sequence into position with its front end raised, means on each side wall of said railroad car for supporting the front wheels of the first and each subsequent truck from side walls of said railroad car with its front end raised, and with the frame of each subsequent truck under the raised front end of the preceding truck positioned, and means for securing each truck thus positioned so that it will neither roll nor slide forward or backward.

6. Apparatus as defined in claim 5 wherein said means for raising and positioning said truck is comprises of a lifting device having wheels, at least one pair of which are powered to permit backing a truck into position while its front end is raised.

7. Apparatus for loading larger highway trucks in a railroad car as defined in claim 5, wherein said means for supporting the front wheels of the first and each subsequent truck is, for each truck, comprised of a horizontal rail on said side wall of said railroad car secured about halfway up the height of said side wall, a plate secured to said horizontal rail by means for permitting said plate to be positioned along the length of said rail, a hinged platform pivotally secured to the bottom edge of said plate so that it may be stowed in a vertical position when not in use, and secured in a horizontal position for supporting the front wheels of a truck, arms pivoted at both sides of said platform with pivot points remote from a hinged side of said platform, and means for securing free ends of said arms remote from said pivot points to said side wall of said railroad car to support said platform in a horizontal position with the weight of the front end of a truck on said platform.

8. Apparatus as defined in claim 6 including guide rails for said lifting device equally spaced parallel to a center line of said railroad car and wherein said wheels of said lifting device are V-grooved, and said guide rails have an inverted V cross section.

9. Apparatus as defined in claim 6 including guide rails for said lifting device equally spaced parallel to a center line of said railroad car, elongated raising platforms on each side of said railroad car between said guide rails and said side walls to provide a channel for said lifting device to pass under the next truck backed onto said platforms in order to raise a front axle of said next truck, and back said next truck into position with its frame extending behind its cab under the front end of the last truck positioned with its front end raised.

10. Apparatus as defined in claim 9 including sloped curbs along the outer sides of said platforms for guiding the rear wheels of trucks while being backed into position.

* * * * *